United States Patent [19]

Rice, Jr. et al.

[11] 4,296,576

[45] Oct. 27, 1981

[54] SLOPED WALL STRUCTURE AND ANCHOR CLIP

[75] Inventors: Hoyt G. Rice, Jr., Ellenwood; Daniel J. Reynolds, Austell, both of Ga.

[73] Assignee: The Anaconda Company, Denver, Colo.

[21] Appl. No.: 74,875

[22] Filed: Sep. 12, 1979

[51] Int. Cl.[3] ..... E04B 7/02

[52] U.S. Cl. ..... 52/90; 52/713; 16/135

[58] Field of Search ..... 52/713, 90, 640, 75, 52/641, 645, 74, 69, 71, 712, 475; 403/171, 128 R; 49/380; 248/284; 16/135

[56] References Cited

U.S. PATENT DOCUMENTS 3,286,404 11/1966 Harrison ..... 52/90 X
3,749,428 7/1973 Hustead ..... 52/90 X
3,950,903 4/1976 Lerch et al. ..... 52/475 X
4,205,496 6/1980 Heirich ..... 52/90

FOREIGN PATENT DOCUMENTS 622777 1/1963 Belgium ..... 16/135

*Primary Examiner*—Carl D. Friedman
*Attorney, Agent, or Firm*—Jones, Thomas & Askew

[57] ABSTRACT

A sloped wall structure is formed from a plurality of rafters arranged in spaced, parallel inclined attitude extending from a lower support surface upwardly to a higher support surface. Anchor clips are positioned at the lower end of each rafter and pivotally connect each rafter to the lower support surface. Similar anchor clips are optionally connected to the upper ends of each rafter and are also pivotally connected to the upper support surface. A baffle plate extends laterally across the wall structure and covers the lower ends of each rafter structure and supports the glass panes or other infill material at the lower edge of the wall structure.

10 Claims, 5 Drawing Figures

SLOPED WALL STRUCTURE AND ANCHOR CLIP

FIELD OF INVENTION

This invention relates to a sloped wall structure of the type which includes glazed infill sheets, and includes hinged anchor clips for mounting each of the sloped rafters on their support surfaces at various angles.

BACKGROUND OF THE INVENTION

A sloped wall structure of the type to extend from the upper surface of a straight wall in an upwardly sloped direction to the vertical surface of a parapet wall assembly usually is formed with a plurality of rafters extending in parallel spaced relationship with respect to one another and purlins extending laterally across the rafters with glass panes or other sheets of infill material extending between the rafters and purlins. The rafters are the main load-bearing members of the sloped wall structure, and the rafters not only support their own weight but also the weight of the horizontal purlins, sheet infill and any external loads placed on the sloped wall structure such as wind forces, rain, snow, ice, etc.

The rafters of a sloped wall structure usually are assembled first at the building site. When the rafters are installed, it is not uncommon that the expected angle of the wall is slightly different than what was planned by the builder. For example, if the sloped wall was planned for 30° from the horizontal, it is not unusual that the wall is finally installed at anywhere from 28° to 32° from the horizontal. If the rafters are anchored at both their upper and lower ends to the supporting surfaces of the lower straight wall and upper parapet wall, the support structures for the rafters must be specially fabricated and/or installed to accomodate the particular final angle of slope of the wall structure.

The usual load bearing connector structure for connecting and supporting the rafters from their lower and upper support surfaces comprises a plurality of anchor clips, one anchor clip being provided at each end of each rafter and rigidly connecting the rafter to the supporting surfaces. The anchor clip usually comprises a base plate that rests flat on and attaches to the support structure and a leg rigidly extending from the base plate and formed at an angle with respect to the base plate which corresponds to the angle of slope of the rafter. Connecting screws connect the leg of the anchor clip to the rafter.

The prior art structures utilized prefabricated anchor clips which are fabricated of one piece construction with a fixed angle between the base plate and the leg, so that the angle formed between the leg and the base plate cannot be altered. Because of this inflexibility of the anchor clip, builders have formed their anchor clips and rafters so that certain construction tolerances exist between them and so that the builder can accomodate variations in the expected slope of the wall structure without requiring a modification of the components. For example, the rafters can be formed with multiple connector openings so that anchor clips can be connected to various ones of the connector openings to support the rafters at different attitudes. In instances where the actual slope of the wall is beyond or between tolerances formed in the rafter structure or in the anchor clip, the builder is required to make further modifications to the structure to accomodate the particular actual slope of the wall structure, or to have special parts made to accomodate the varying slope of the wall structure.

While builders can work with the tolerances provided in particular components of a wall structure to accomodate slight variations in the angle of the wall structure, the same anchor clips cannot be used to install one wall structure with a slope of 30° from the horizontal and another wall structure that is 45° or 60° from the horizontal. Different anchor clips are required for variations of this type or, in the alternative, the holes punched in the ends of the rafters would have to be positioned differently to accomodate the leg of the anchor clip in a different position with respect to the rafter.

The prior art sloped wall structures use fabrication and installation techniques at the upper portion of each rafter that requires another anchor clip which is different from the anchor clip at the base of the wall structure. This creates the need for different structures at the upper and lower ends of each rafter to accommodate wall structures of different slopes.

SUMMARY OF THE INVENTION

Briefly described, the present invention comprises a sloped wall structure and an anchor clip which permits the builder to use anchor clips of a single design to support the wall structure at both its bottom and top edges at various angles from the horizontal. The new anchor clip comprises a base plate for mounting to a support surface, such as to the upper sill structure of a straight wall and to the vertical surface of a parapet wall, and an anchor leg which is pivotally connected to the base plate and which extends into and rigidly connects to the end portions of the rafters of the wall structure. The pivotal connection between the base plate and anchor leg of the anchor clip allows each rafter to individually pivot on its supporting structure. Shims or other adjusting elements can be inserted between the upper anchor clip and its support surface to make fine adjustments in the angle of slope of each rafter.

After the rafters have been assembled in the sloped wall structure, a baffle plate is mounted across the lower ends of the rafters, and purlins are extended across the rafters for supporting the glass panels or other infill sheets. The baffle plate is of standard construction for all wall structures formed with the anchor clip disclosed herein, regardless of the particular slope of the wall structure, and break metal cover extends from the baffle plate to the sill to enclose the lower ends of the rafters, etc. The break metal cover is not a load bearing member and is inexpensive to construct and to install but usually is fabricated with dimensions that correspond to the particular slope of the wall structure.

Thus, it is an object of this invention to provide a sloped wall structure that utilizes standardized parts for installing the rafters of the structure, regardless of the particular slope of the wall structure.

Another object of this invention is to provide a sloped wall structure with anchor clips of standard design that are installed both at the tops and bottoms of the rafters to support the rafters in their sloped attitudes without regard to the particular slope of the wall structure.

Another object of this invention is to provide an improved anchor clip for use in sloped wall structures, the anchor clip being useful to support the rafters of a wall structure at various angles with respect to the horizontal.

Another object of this invention is to provide a method of installing a sloped wall structure wherein more standardized parts can be used and wherein the wall structure can be expediently and inexpensively installed.

Other objects, features and advantages of the present invention will become apparent from reading the following specification, when taken in conjunction with the accompanying drawings.

DETAILED DESCRIPTION

Figure 1:
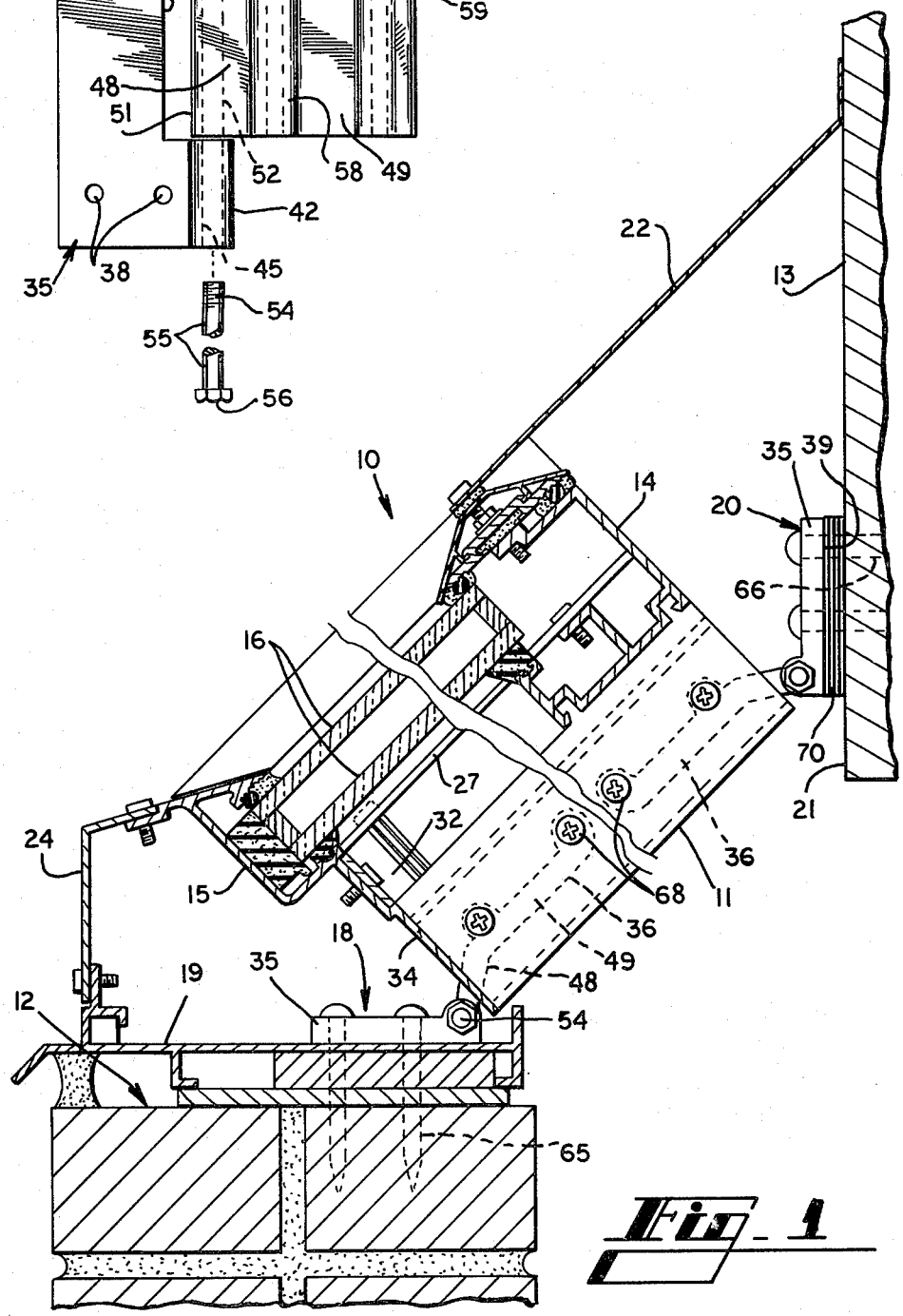
FIG. 1 is a side elevational view, in cross section, with portions removed therefrom, of a sloped wall structure utilizing the improved anchor clips.

Referring now in more detail to the drawings, in which like numerals indicate like parts throughout the several views, FIG. 1 illustrates a sloped wall structure 10 of the type that includes a plurality of spaced, parallel sloped rafters 11 extending from a lower support 12 to an upper support 13. Purlins such as upper horizontal purlin 14 extend laterally across rafters 11, and baffle plate 15 extends laterally across the lower ends of the rafters. The baffle plate 15 and purlins 14 accommodate the infill material such as glass panels 16.

A plurality of anchor clips 18 are spaced across the sill structure 19 of the lower support 12, with an anchor clip 18 is located at the lower end of each rafter 11. Similar anchor clips 20 are mounted on the upper support 13, with the anchor clips 20 also being spaced apart and aligned with the upper ends of the rafters 11. In the embodiment illustrated, the sill structure 19 forms on the lower support 12 a horizontal support surface for the anchor clips 18, while the vertical surface of the parapet wall 21 forms the vertical support surface for the anchor clip 20. Flashing such as sheet metal 22 extends from the vertical surface of parapet wall 21 to the upper purlin 14, and break metal cover 24 extends from the upper portion of baffle plate 15 to the sill structure 19.

Figure 5:
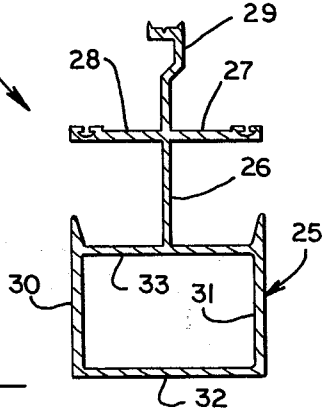
FIG. 5 is a cross sectional illustration of a rafter of the type that can be utilized in a sloped glazed wall structure.

In the disclosed embodiment of the invention the particular rafter structure (FIG. 5) comprises an elongated rectilinear structure which includes a lower box 25, upwardly extending web 26, support flanges 27 and 28 and upper flange 29. The lower box 25 includes parallel spaced side walls 30 and 31 which are oriented in vertical planes, and lower and upper walls 32 and 33 that extend laterally between the side walls. The structure is constructed so as to support the infill sheets such as the glass panels 16 of the sloped wall structure. Also, upper purlin 14 is shaped to support the infill sheets.

Baffle plate 15 extends across the bottom surfaces of the rafters 11 and is connected thereto by clips 32. The baffle plate accomodates the infill sheets and functions as a purlin at the lower edge portion of the wall structure. Clips 32 are connected to the laterally extending flanges 27 or 28 of the rafters 11. Baffle plate 15 includes a plurality of spaced slots 34 at equally spaced intervals therealong with the slots 34 each being located at the lower end of the box 25 of a rafter 11.

Figure 2:
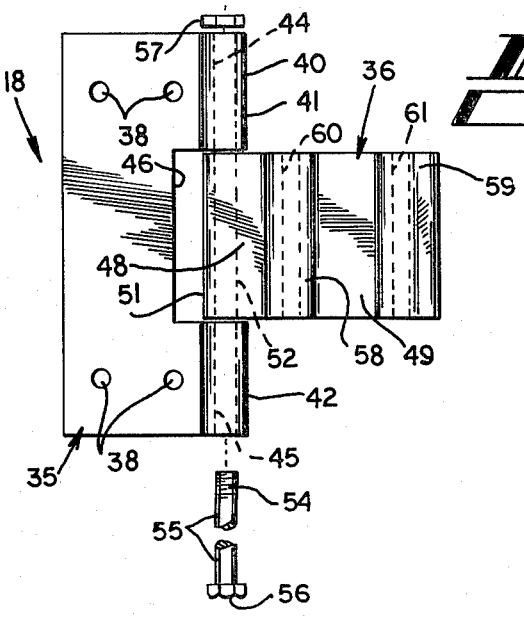
FIG. 2 is a plan view of the improved anchor clip.
Figure 3:
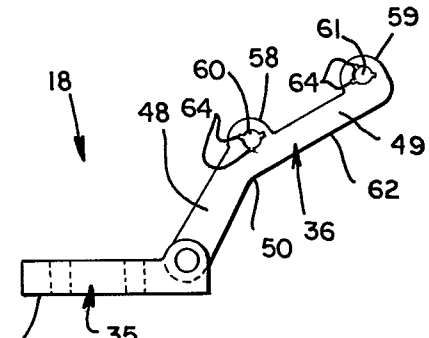
FIG. 3 is a side view of the anchor clip of FIG. 2.
Figure 4:
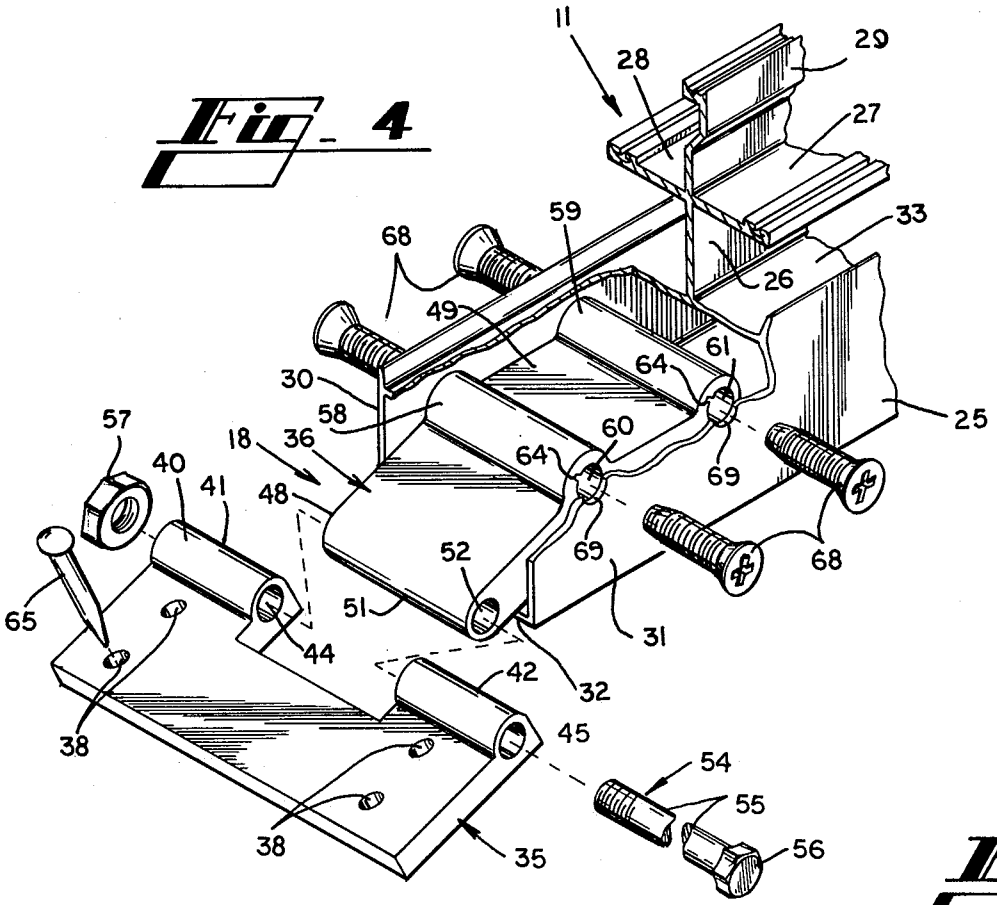
FIG. 4 is a perspective illustration of the anchor clip and the lower end portion of a sloped rafter, with portions of the rafter removed for clarity and with some elements shown in expanded relationship.

As illustrated in FIGS. 2, 3 and 4, the anchor clips 18 each include a base plate 35 and an anchor leg 36. Base plate 35 includes a substantially flat bottom surface 39 which is to be mounted in abutment with the sill structure or other flat supporting surface, and a plurality of connector openings 38 extend therethrough. A hinge boss structure 40 is formed at one edge portion of the base plate. The boss structure is formed in boss elements 41 and 42, with each boss element defining pivot pin openings 44, 45, respectively. The openings 44, 45 are aligned with each other, are circular in cross section, and are of equal diameter. A gap 46 is formed in base plate 35 between boss elements 41 and 42.

Anchor leg 36 is of a width substantially equal to the space between boss elements 41 and 42, and is substantially equal to the space between vertical side walls 30 and 31 of rafter 11. Anchor leg 36 includes support shank 48 and brace section 49, with an angle 50 formed between the shank and brace section. A rectilinear pivot pin opening 52 is formed through the edge portion of support shank 48 which is remote from brace section 49, with the pivot pin opening being circular in cross section and of a diameter nearly equal to the diameter of pivot pin openings 44 and 45 of the base plate boss elements 41 and 42. A pivot pin 54 includes a stem 55, cap 56 and nut 57. The stem 55 of pivot 54 extends through the pivot pin openings 44, 45 and 52 of the base plate 35 and anchor leg 36 of the anchor clip. Thus, anchor 36 is pivotably supported on base plate 35.

Anchor leg 36 includes a first convex protrusion 58 at angle 50 and a second convex protrusion 59 at its edge portion thereof remote from its pivot pin opening 52. First and second connector openings 60 and 61 are formed in anchor leg 36 radially inwardly from the other surfaces of convex protrusions 58 and 59. The arrangement is such that the connector openings 60 and 61 are located away from the lower surface 62 of the anchor leg 36 so that the strength characteristics of the anchor leg will not be reduced by the presence of connector openings 60 and 61. The connector openings 60 and 61 extend entirely through anchor leg 36 and include rectilinear slots 64 extending along their lengths. The slots 64 permit limited deformation in the surfaces of the connector openings as a self tapping screw 68 is threaded therein, as will be described in more detail hereinafter.

Support shank 48 of anchor leg 36 is progressively larger in thickness from angle 50 toward its pivot pin opening 52 (FIG. 3) so that the material surrounding pivot pin opening 52 retains strength that is approximately equal to the strength of the other portions of the anchor leg 36.

When the sloped wall structure 10 is being assembled on the sill structure 19 (FIG. 1), the upper anchor clips 20 are attached to the upper ends of the rafters and the lower anchor clips 18 are placed along the sill structure in spaced relationship, at distances corresponding to the design spacing between the inclined rafters 11. Connecting elements such as pins 65 are inserted through connector openings 38 of base plate 35 of the lower anchor clips 18 to rigidly mount the base plate to the horizontal support structure 12 through sill 19. The lower ends of the rafters are then mounted to the lower anchor clips by inserting the lower ends on the anchor clips or by attaching the anchor legs 36 to the purlins and then connecting the anchor legs to the base plates 35 with pivot pins 54. The upper ends of the rafters are then located on the upper wall surface 13 and connectors 66 are inserted through the base plate 35 of the upper anchor clips 20 and into the vertical support structure 13. When the anchor legs are being connected to a rafter, the worker inserts the anchor leg 36 into the open end of the lower box 25 of the end portion of each rafter 11 and aligns the connector openings 60 and 61 of the anchor leg 36 with the openings 69 in the side walls 30 and 31 of the rafter. Self tapping helical threaded screws 68 function as connecting elements in that they are inserted through the connector openings 69 of the rafters and into opposite ends of connector openings 60 and 61 of the anchor leg 36, thus rigidly connecting anchor leg 36 to the end portion of the rafter 11. This causes rafter 11 to be supported in a pivotal relationship on sill structure 19. If the base plate of the upper anchor clip 20 does not rest flat against its support surface 13, the base plate 35 is moved along the lengths of its connector elements 66 and shims 70 are inserted between the bottom surface 39 of base plate 35 and the surface of upper support 13 to adjust for the variations and position of the upper anchor clip 20, and the connector elements 66 are subsequently tightened.

After a plurality of rafters have been installed in the manner as described herein, baffle plate 15 is inserted about the lower end of rafters 11, with the slots 34 in the baffle plate 15 being inserted about the anchor legs 36 (FIG. 1), with the baffle plate 15 connected to the clips 32 mounted on each rafter 11. Also, purlins, such as upper purlin 14, are mounted across rafters 11, as necessary, and the glass panes or other infill sheets 36 are inserted in the structure together with their various seals, etc. Flashing 22 and cover 24 are later attached to the structure.

It will be noted that the anchor clips 18 and 20 at both the lower and upper end portions of the rafters 11 are identical in construction, and that the baffle plate 15 is uniform in its construction regardless of the angle of the sloped wall structure 10. The only varying structural elements in the assembly that vary when a change in the slope of the wall structure is detected are flashing 22 and cover 24, but these elements are not load bearing elements and usually are the last to be installed and are the least expensive elements in the structure.

If the wall structure is angled more closely to an upright attitude, the load carried by lower anchor clip 18 is increased. It will be noted that brace section 49 extends along the length of the rectilinear rafter 11 so that its connector openings and the connector openings of the rafter are centrally located in the height of side walls 30 and 31 of the rafter and therefore receive maximum support of the side wall material, whereas support shank 48 is angled closer to the vertical than the slope of rafter 11, so that more compressive forces than bending forces are present in support shank 48. As the angle of sloped wall structure 10 increases, the angle of support shank 48 also increases closer to the vertical, therefore increasing the ratio of compressive forces to bending forces in the support shank as the weight of the wall structure on the support shank increases. It will be noted that connector opening 60 of anchor leg 36 is located closer to a position directly over pivot pin 54 because of the angle between support shank 48 and brace section 49. Moreover, the connector opening 60 is located substantially at the upper end of support shank 48 so that the downward forces applied by the connector screws 68 in connector opening 60 are more vertically oriented along the length of support shank 48. As a result, less bending forces are applied to support shank 48.

While a particular wall structure is illustrated herein, it should be understood that various different supporting surfaces, rafter shapes and other elements can be included as a part of the described invention. Also, it should be understood that the foregoing relates only to a preferred embodiment of the present invention and that numerous modifications or alterations may be made therein without departing from the spirit and the scope of the invention as set forth in the appended claims.

We claim:

1. A sloped wall structure for extending between a lower horizontal support and an upper vertical support, a plurality of rectilinear rafters positioned in spaced relationship with respect to one another and inclined upwardly from the lower horizontal support to the upper vertical support, infill sheets mounted on said rafters and forming with said rafters a sloped wall, each of said rafters including in cross section a pair of spaced vertically oriented parallel walls, an anchor clip connected between the lower end of each of said rafters and the lower horizontal support, each of said anchor clips including a base plate and a leg, said base plate including means for rigidly mounting said base plate to the lower horizontal support and a hinge boss at one edge portion thereof, said leg including means for rigidly mounting said leg between the spaced walls of the rafters and a hinge boss at one edge portion thereof constructed to mate with the hinge boss of said base plate, a pivot pin extending through the hinge bosses of the base plate and the leg of each anchor clip to hingedly anchor the sloped wall structure to the lower horizontal support.

2. The sloped wall structure of claim 1 and wherein anchor clips are connected between the upper end of each of said rafters and the upper vertical support with the base plate of each anchor clip mounted to the vertical support and the leg rigidly mounted to said rafter, whereby the sloped wall structure is hingedly mounted to the vertical support.

3. In a sloped wall structure of the type including a plurality of rectilinear rafters positioned in spaced relationship with respect to one another and inclined upwardly from a lower horizontal support surface to an upper vertical support surface and each including in cross section across its length a rectangular enclosure with vertically oriented spaced sidewalls, an anchor clip connected to the lower end portion of each rafter and to said lower support surface and comprising a base plate of a width wider than said rectangular enclosure and mounted on said lower support surface and a leg of a width approximately the same as the internal width between the spaced sidewalls of said rafter and inserted in said rectangular enclosure and connected to said spaced sidewalls, and said base plate and leg including therebetween a hinge connection whereby said rafters are pivotally mounted on said lower horizontal support.

4. The sloped wall structure of claim 3 and wherein said leg of each anchor clip comprises at one end an elongated hinge pin opening extending therethrough for receiving a pivot pin therethrough, and a pair of connector openings spaced from each other and from said hinge pin opening and extending therethrough and parallel to said hinge pin opening for receiving connecting elements, and wherein each of said rafters defines at lower end a pair of connector openings through bo said sidewalls which are sized and shaped to align with the connector openings of said leg.

5. An anchor clip for supporting a rafter of a sloped wall structure comprising a base plate for attachment to a supporting wall and the like, said base plate including a plurality of connector openings extending therethrough for receiving connector elements and a hinge boss, said hinge boss comprising a pair of spaced boss elements defining aligned pivot pin openings therethrough for receiving a rectilinear pivot pin, an anchor leg for attachment to a rafter, said anchor leg being angled intermediate its ends and including a lower normally upwardly extending support shank and an upper normally laterally extending brace section, said support shank including at its lower end portion a boss of a width approximately equal to the space between the spaced boss elements of said base plate and defining a pivot pin opening therethrough for alignment with the aligned openings of said pair of spaced bosses and for receiving the rectilinear pivot pin, said anchor leg including at its angle a first opening extending therethrough and said brace section including at its end portion remote from said support shank a second opening extending therethrough, said first and second openings extending parallel to said pivot pin opening and said second opening being laterally offset from a plane through the pivot pin opening and the first opening of said anchor leg, and a pivot pin projecting through the pivot pin openings of said base plate and anchor leg whereby the brace section of the anchor leg is inserted into a rafter and the brace section is aligned with and connected to the rafter with connectors extending through the rafter and the first and second openings of said anchor leg and the support shank extends at an angle with respect to the length of the rafter and the anchor clip supports a rafter from a wall structure in a pivoted relationship with the wall structure.

6. The anchor clip of claim 5 and wherein said anchor leg includes convex projections at its angle and at its end portion remote from its said boss, and wherein said convex projections extend about said first and second openings.

7. In combination a rectilinear sloped rafter of a sloped wall structure and an anchor clip, said rafter comprising a pair of spaced vertical oriented walls with each wall defining connector openings spaced along its length with the openings of one wall aligned across the rafter with the openings of the other wall, said anchor clip comprising a base plate for rigid attachment to a support surface, said base plate including a pair of spaced boss elements with aligned pivot pin openings extending therethrough, said anchor clip further comprising an anchor leg for rigid attachment to said rafter, said anchor leg including a support shank and a brace, said support shank including at its edge portion remote from its brace a pivot pin opening extending therethrough for alignment with the pivot pin openings of said base plate, said support shank being angled with respect to said brace and connector openings formed through said anchor leg with a first connector opening extending therethrough at the angle between said support shank and said brace and a second connector opening extending therethrough at the edge portion of said brace which is remote to said support shank, a pivot pin extending through said pivot pin openings of said base plate and said anchor leg, and connecting elements extending through the connector openings of the vertically oriented walls of said rafter and the connector openings of said anchor leg, whereby said anchor leg is pivotally connected at one edge portion thereof to said base plate and its support shank extends from said base plate at an angle with respect to the length of the rafter and its brace extends along the length of the rafter and the rafter is pivotally supported by said base plate on the support surface.

8. The combination of claim 7 and wherein anchor clips of the type described are connected to both ends of the rafter and to a support surface.

9. The combination of claim 7 and wherein the support shank of said anchor clip extends upwardly from said base plate at an angle closer to the vertical than the angle of the rafter from the vertical.

10. The combination of claim 7 and wherein a plurality of rafters and anchor clips of the types described are mounted in spaced relationship in a wall structure with the lower ends of the rafters located along a common line, and further including a baffle plate extending about the lower ends of said rafters.

* * * * *